US006392356B1

(12) United States Patent
Stevens

(10) Patent No.: US 6,392,356 B1
(45) Date of Patent: May 21, 2002

(54) ACTIVE MATRIX VACUUM FLUORESCENT FLAT PANEL DISPLAY

(75) Inventor: Jessica L. Stevens, San Mateo, CA (US)

(73) Assignee: Telegen Corporation, San Mateo, CA (US)

( * ) Notice: Subject to any disclaimer, the term of this patent is extended or adjusted under 35 U.S.C. 154(b) by 0 days.

(21) Appl. No.: 09/859,314

(22) Filed: May 14, 2001

Related U.S. Application Data

(60) Provisional application No. 60/204,734, filed on May 16, 2000.

(51) Int. Cl.[7] ..... H01J 31/12

(52) U.S. Cl. ..... 315/169.3; 315/169.4; 313/495; 313/496

(58) Field of Search ..... 315/169.3, 169.4; 313/495, 496, 497

(56) References Cited

U.S. PATENT DOCUMENTS 5,739,634 A * 4/1998 Kinoshita et al. ..... 313/496

* cited by examiner

*Primary Examiner*—David Vu
(74) *Attorney, Agent, or Firm*—Victoria S. Kolakowski

(57) ABSTRACT

The present invention teaches a matrix addressed flat panel display device. A substrate is contained within a vacuum envelope with a translucent pane to allow viewing of the image. The substrate panel has one side covered with phosphor-coated anode pads, and the other side with driver circuitry for selectively activating individual conductive anode pads by electric connections using vias or similar electric connections through the substrate. An electron source such as thermionic filaments are disposed between the phosphor-coated anode pads and the translucent pane.

10 Claims, 2 Drawing Sheets

ACTIVE MATRIX VACUUM FLUORESCENT FLAT PANEL DISPLAY

PRIORITY OF INVENTION

The present application claims priority from U.S. Provisional Patent Application No. 60/204,734, "Active Matrix Vacuum Fluorescent Flat Panel Display" filed May 16, 2000.

FIELD OF THE INVENTION

The present application teaches an apparatus and method for applying an active matrix to the Vacuum Fluorescent Display ("VFD") in order to maximize the brightness of the VFD. This invention teaches how to integrate an active matrix to the VFD using either single crystal silicon chips or thin film transistor ("TFT") techniques for the active matrix, and generally relates to the areas of flat panel displays.

BACKGROUND OF THE INVENTION

The Vacuum Fluorescent Display ("VFD") is a flat panel display that has been manufactured in Japan and Russia for the last two decades. The VFD has found a marketplace as a messaging display for equipment such as clocks, radios, tape players and CDs in automobiles. It is also found on appliances such as microwave ovens. The VFD is viewed by the industry as a very bright and reliable display for low-resolution alphanumeric and icon displays. It has never found use as a high-resolution graphics display that could be used in the computer monitor, or television markets. The reason this has not occurred is that the high-resolution displays must support animated images, and VFDs presently cannot support such animation.

In order to produce animation the display must be refreshed at some frame rate that is fast enough that the image does not appear to flicker to the human eye. This minimum frame rate is around sixty frames per second. In such displays the frame rate is usually selected at around 75 frames per second so that the frame rate does not coincide with the 60 cycles per second of the alternating current electrical power source.

Cathode ray tubes ("CRTs") are beam-driven displays. In CRTs the frame is painted pixel-by-pixel by sweeping a beam of electrons in a raster scan from side-to-side and down the frame until the complete image is formed. In such displays the electron beam is only momentarily on each phosphor dot (pixel), once for each frame. The human eye's response is too slow to catch the beam movement and interprets the response as a steady lighted dot, although in reality it is flickering at 60 or 70 times per second. Instead of a flicker the eye sees a low brightness.

Due to the short dwell time of the beam on a particular pixel, the light from the phosphor of the pixel is highly limited. To compensate for the short dwell time the beam power is boosted to extremely high powers and voltages (30,000 volts for the color TV). If the television beam were to remain fixed on the phosphor dot, then that pixel would be extremely bright for a short time and then burn out.

Today all flat displays, including VFDs, are matrix driven devices as opposed to beam driven devices. Matrix driven means that driving the image is obtained by activating columns and rows. The point where a column and row meet defines a pixel. Present matrix driven displays are commonly line-driven as well, as opposed to either raster-scanned (CRTs) or matrix displays that are individually addressable pixel-by-pixel. This means that a total line of the display is enabled together by a single line driver and then image data for the line is fed in parallel to all the columns. The result of this is that the dwell time of the electrons on the phosphor is about a thousand times longer than it is for a raster-scanned display. This means that the electron power can be greatly reduced so that a line scanned VFD need only have 10 to 50 volts to energize the electrons stimulating the phosphors.

The brightness of the line-driven display is impacted not by the number of dots or pixels in a line, but by the total number of lines in the display, as the line may be activated only for the length of time of the given line is active during a particular frame. Hence, increasing the number of lines decreases the amount of time that each line is active, and hence diminishes the brightness of the line. The high brightness of previous VFDs is due to the fact that the matrix in a messaging display has only a few lines (from 1 to 10). The more lines the display has, the dimmer is the image for a particular voltage. This means that a high-resolution display with 500 lines is too dim, and that more brightness has to be attained by turning up the voltage.

However, high voltage displays require that the driver system must be able to handle voltages in the 200 and 300-volt range to obtain the brightness of a line-driven VFD. This causes the driver system to be prohibitively expensive, and therefore not economical. The matrix line scan cannot produce an economically viable high-resolution display.

One solution to this problem is to turn the phosphor pixels on for the total length of the frame. This can be accomplished using a transistor circuit to drive each individual pixel. This was implemented by Peter Brody at Westinghouse in the early 1970s and is called the active matrix ("AM"). Today liquid crystal displays employ the active matrix and are called active matrix liquid crystal diodes ("AMLCDs"). The active matrix is typically made from amorphous silicon, or poly-silicon.

In 1981, the concept of an active matrix vacuum fluorescent display ("AMVFD") was published by Sahiro Uemura and Kentaro Kiyozumi, engineers working for Ise Electronics, Japan, in the *Transactions on Electron Devices*, Vol. Ed-28, No. 6, June 1981. In that paper they discussed a pixel memory system consisting of two p-channel transistors and a capacitor in a monolithic integrated circuit silicon chip. This enabled the display to operate at 100 percent duty factor with a 60-Hz refresh rate. The results were, "in the enhancement of phosphor brightness up to 4000 to 5000 fL at Vp=30 V." Having a display with such brightness potential allows it to be used as a projection system, or the filament temperature may be significantly reduced for a substantial power saving, or high filtration can be added to make a daylight-readable display.

Nine years later in the papers for the 1st International CdSe (Cadmium Selenide) Workshop, 1990, a paper presented by Shimojo, Okada and Kamogawa of Ise Electronics, Japan discussed an AMVFD that utilized an active matrix using thin film transistors ("TFTs") fabricated with cadmium selenide for the thin film semiconductor. In Japan, cadmium selenide is considered to be very poisonous and therefore, Ise dropped the use of cadmium selenide shortly thereafter in favor of single crystal silicon chips.

The semiconductor circuits used in AMVFDs are fabricated utilizing CMOS (Complementary Metal Oxide Semiconductor) technology. The CMOS circuit is constructed with an insulating layer of glass deposited over the circuitry and interconnects, with an aluminum anode pad deposited over the glass and connected to the drain of a power FET (Field Effect Transistor) under it. Phosphor of the proper formulation is then deposited on the aluminum pads. These chips were then mounted on the base glass of the vacuum envelope with filament wires strung over the phosphors. The image is viewed through the filaments, but they are so thin that they are not seen at the viewing distance.

Prototype displays were tested and were found to have four times the brightness of commercially available VFDs. The difficulty with the silicon chip system is that each chip has to be carefully aligned with the chip on either side of it and with the chip over and under it. Also, since the chips cannot be abutted up against each other (because chips need area around the circuitry to be "diced" and for power lines) and because each chip is not exactly like the next chip, some room has to be afforded between each chip. This reduces the amount of phosphor surface area and also the number of pixels per linear unit, because the space between chips must also be the same as the space between pixels on the chip otherwise the display will not be uniform, but will have lines crisscrossing it corresponding to the cracks between the chips. Thus, high-density graphics displays are not possible using the silicon chip technique.

Another problem with present AMVFD displays is that they have no gray scale capability beyond a simple binary (single bit) display. In a binary system the pixels are turned on or off with no intermediate levels of shading. In a true grayscale system there are a number of intermediate levels of shading, either with continuous shading for an analog driven system or a number of discrete levels determined by the number of bits for a binary driven system. The simple on/off binary arrangement is inadequate for providing color or high-resolution displays.

Ise was not able to follow up on their AMVFD work because the use of monolithic silicon chips for the active matrix was economically prohibitive. Today Ise markets small silicon chip-driven AMVFD of low resolution for alphanumeric displays and which is the mainstay of their VFD business.

Other companies have attempted to create active matrix displays, also with limited success. One example is the active matrix display taught in Curtin et al., U.S. Pat. No. 5,686,790 and assigned to Candescent Technologies Corporation. In this display a substrate contains a matrix of holes containing emissive electron sources known as Spindt cathodes. A glass pane patterned with phosphors is spaced above the substrate by a collar that surrounds the display area and spaces the glass pane above the electron sources, and a vacuum is created between the glass pane and the substrate. Electrons are projected from the Spindt cathodes away from the substrate onto the phosphor of the glass pane to produce the image. In one embodiment the rear pane forms an envelope that encloses the substrate. Control circuitry is placed external to the display and electrically connected to the cathodes by means of traces through the substrate.

This display has several problems. Because the phosphor pixels are located on the glass pane and a vacuum is created, the glass bows inward, and a non-uniform emission pattern is created on the pane. This requires the use of internal spacers between the substrate and display glass pane, which dramatically complicates construction of the display and degrades the quality of the image. In addition, focusing the electron streams is difficult because all of the control circuitry is located within the substrate and hence close to the electron source. Small angular discrepancies at the source lead to significant linear discrepancies at the glass pane.

As a result of these and other problems, the Curtin et al. display cannot be manufactured to provide the performance needed for high-resolution full-motion displays at an affordable cost.

One method of overcoming the control issues of the Curtin et al. display is to replace the arrangement of a cathode electron source spaced from a phosphor pixel in a vacuum with a sandwich of cathode and anode strips with an electroluminescent (EL) material disposed between them. Two examples of such inventions are Khormaei et al., U.S. Pat. No. 5,652,600, assigned to Planar Systems, Inc. and Swirbel et al., U.S. Pat. No. 6,091,194, assigned to Motorola, Inc. These displays have suffered from difficulty in creating EL materials that can provide a full range of color. Although significant progress has been made with such displays, present materials and manufacturing techniques do not allow full-motion, high-resolution color displays to be manufactured at an affordable cost.

Although the AMVFD has been invented and has demonstrated it can solve the brightness and power problem associated with passive matrix VFDs, no one has been able to capitalize on it because of an inability to produce a manufacturable approach to achieving it.

SUMMARY OF THE INVENTION

The present invention teaches an active matrix vacuum fluorescent display device. The display has an envelope for enclosing a space containing a vacuum. The envelope further comprises a first pane of a transparent material, preferably glass, and a second pane substantially parallel to the first pane, enclosing a vacuum space. A substrate panel having first and second parallel sides is disposed between the first and second panes of the envelope, within the enclosed vacuum space. The substrate panel and the first pane are spaced from one another, with the first side of the substrate panel being closer to the first pane of the envelope than is the second side of the substrate panel. A plurality of conductive anode pads are disposed on the first side of the substrate panel, those conductive anode pads being covered with light-emissive phosphor coatings.

Driver circuitry for selectively activating individual conductive anode pads is disposed on the second side of the substrate panel. A plurality of conductive vias connect the conductive anode pads to the driver circuitry, with a unique via connecting each separate conductive anode pad to the driver circuitry.

Finally, an electron source is disposed between the substrate panel and the first pane of the envelope. It is spaced from the first pane such that a vacuum space is maintained between the electron source and the conductive anode pads. In a presently preferred embodiment the electron source comprises a plurality of thermionic filaments.

The substrate may be disposed entirely within the vacuum envelope, or may be integrated into the envelope by use of a first and second side collar, which seal the space between the substrate and the first and second panes, respectively.

In an alternative embodiment the substrate panel replaces the second pane and comprises the rear plane of the display.

DETAILED DESCRIPTION OF THE INVENTION

The described invention is composed of three major subsystems: a substrate base with active matrix addressed phosphor-coated anode pads for each subpixel; a driver system for activating the pixels; and vacuum envelope vessel enclosing these subsystems and containing an electron source. Each subsystem is described separately below.

The Substrate

Figure 2:
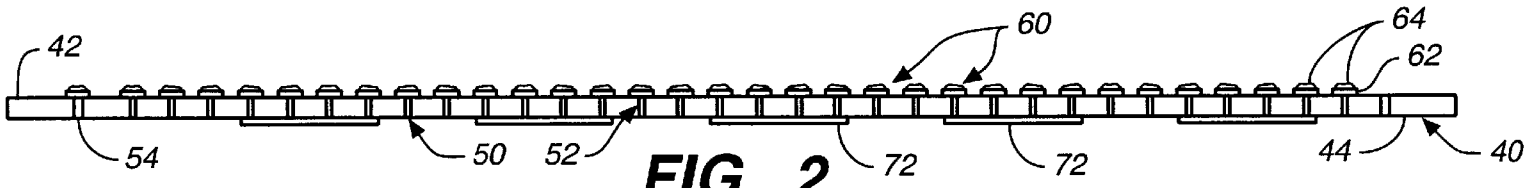
FIG. 2 illustrates a cross-section of a portion of the substrate of a flat panel display according to the present invention.
Figure 3:
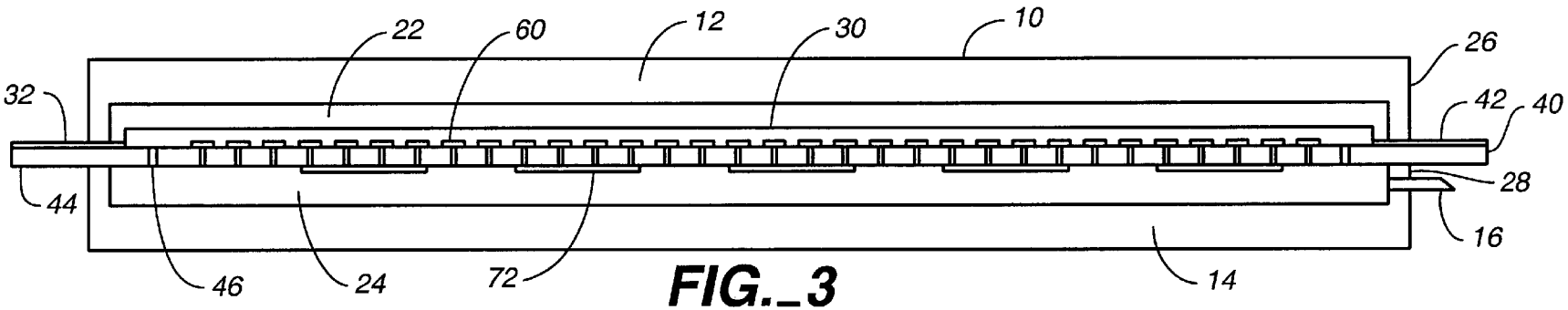
FIG. 3 illustrates a cross-section of a flat panel display according to the present invention.

In a presently preferred embodiment of the present invention illustrated in FIGS. 2 and 3, the substrate 40 is a thin (0.004–0.010 inch) glass plate that has been patterned in such a way as to interconnect and support the electronic driver circuitry with the phosphor pixel area. It is somewhat analogous to a multi-layer printed circuit board used in standard electronic construction. In this embodiment, the phosphors and the active matrix drive electronics 70 are placed on opposite sides of the substrate 40. Connection of the drive electronics mounted on the rear 44 of substrate 40 with the phosphor pixels on the front 42 of substrate 40 is accomplished through metalized holes or "vias" 50 analogous to the "plated-thru holes" in a multi-sided printed circuit board. Each metalized via 50 connects to a metal anode pad 62 on the front 42 of substrate 40, onto which the phosphor material 64 is deposited. Because the electronic drive circuitry 70 is not mounted on the same side of substrate 40 as the phosphor-coated subpixels 60, metal anode pads 62 can be fabricated to maximum size for the required pixel pitch.

Substrate 40 is constructed in the following manner. At each subpixel, a metalized hole 52 is formed in the glass of substrate 40 by etching, drilling, punching, or any other way known in the art. For example, double-sided etching can produce 0.002 in. holes in a 0.004 in. glass plate. Metal is deposited on both sides of substrate 40 and is shorted to the other side through the array of holes 52 corresponding to the pixel array. On the front side 42 of substrate 40, the metal is etched into anode pads 62 the size of the sub-pixel. On the rear side 44 of substrate 40, the metal is etched into a first metal contact pattern 82 that will contact the outputs of the driver electronics 70. The metal 54 that fills holes 52 serves to electrically connect anode pads 62 to driver electronics 70.

On the rear of substrate 40, the electronic drive circuitry 70 is fabricated or mounted (depending upon the type of circuitry used) and connected to the appropriate metalized via 50 leading to the appropriate metal anode pad 62 to be controlled. Any complex interconnections between electronic driver components or electronic drivers to anode pads 62 are accomplished using either multi-layers of metalization inside the substrate 40 (similar to the multiple layers in a complex printed circuit board) or on the rear of the substrate 40 using multiple conductive depositions and insulators. The driver electronics 70 can either be silicon chips 72 or can be fabricated directly on the rear of substrate 40 using thin film transistor methods.

Figure 1:
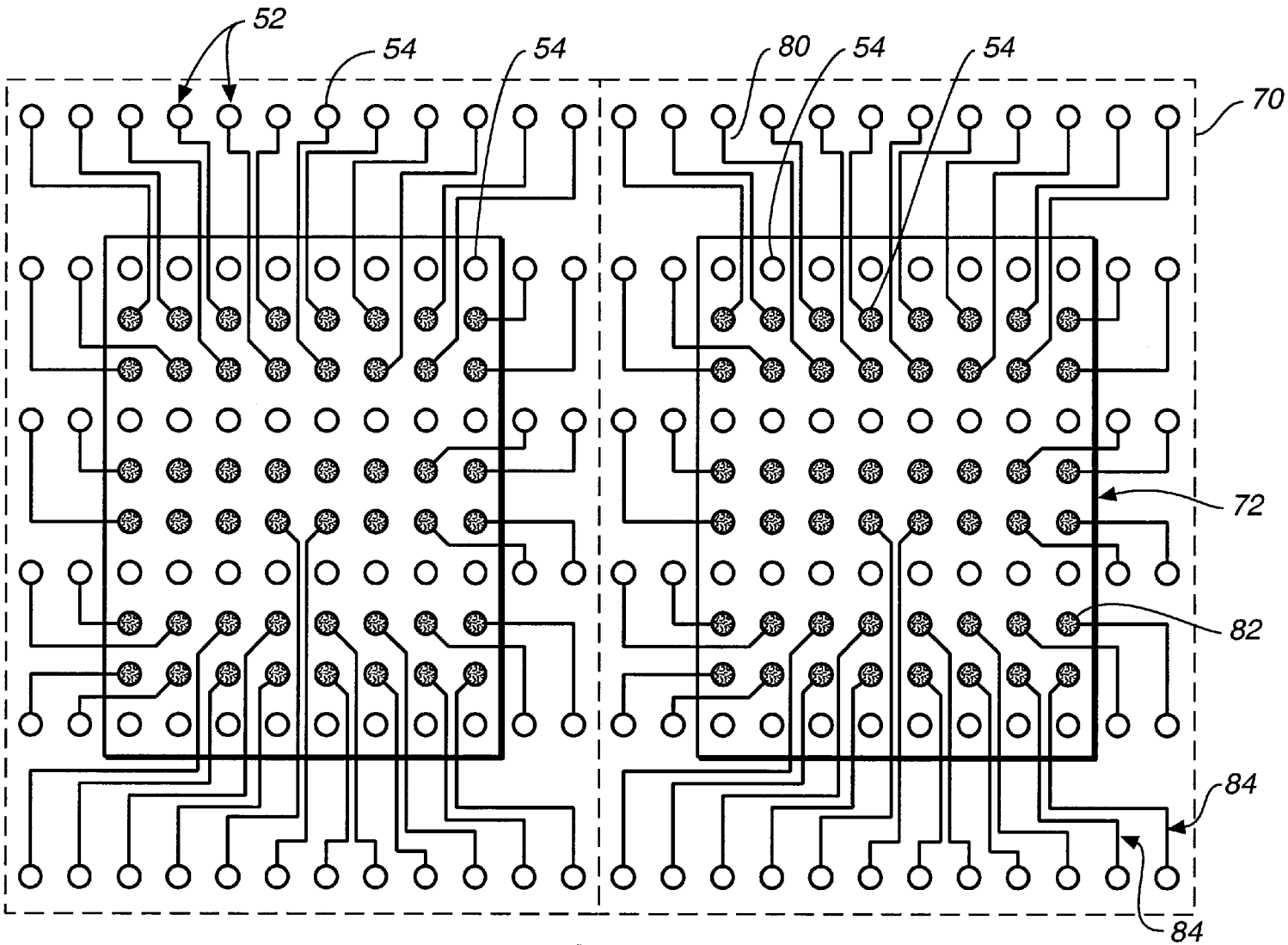
FIG. 1 illustrates a rear view of a flat panel display according to the present invention.

In the silicon chip embodiment, the Field Emission Transistors ("FETs") on silicon chips 72 can be denser than the pixel array (for example, the pixel array can be an 0.004× 0.012 in. pattern while the anode connections are on a 0.004×0.004 inch pattern.) This means that silicon chip 72 can service pixels in a swath around it that allows a separation between chips 72 but still keeps the phosphor subpixels 60 in a uniform array on the front 12 side of substrate 40, as illustrated in FIG. 1.

FIG. 2 is a side view of a section of substrate 40 showing the connecting vias 50 with silicon chip drivers 70 on the rear 44 of substrate 40 and the phosphors 64 deposited on metal anode pads 62 on the front 42 of substrate 40.

An embodiment of a system according to the present invention is shown in FIG. 3. Substrate 40 is then sealed into a vacuum vessel or envelope 10 with an electron source, such as thermionic filaments 30, mounted over substrate 40 and between the front glass pane 12 of the vacuum vessel 10 and the front side 42 of substrate 40. The display plate is at the rear 14 of the envelope 10 and the filament 30 is near the front 12 of envelope 10.

Referring to FIG. 3, substrate 40 is sandwiched between the front pane 12 and rear pane 14. Substrate 40 has air equalization holes 46 through it in four corners to ensure that all the air can be evacuated from the display. The air equalization holes 46 are plated with metal and biased with a negative voltage so that electrons generated in the front section of the display by the thermionic filaments 30 do not migrate to the rear section of the display and interfere with the operation of the driver chips 72 bonded to the rear of substrate 40.

In an alternative embodiment, anode pads 62 are not electrically connected to driver electronics 70 by holes 52 directly through substrate 40. In this embodiment electric connections are achieved using vias and connections using techniques commonly known to the printed circuit ("PC") board art. By using a multiplayer substrate 40, electric connections 32 to the exterior of the vacuum envelope 10 may be accomplished by means of electrical connections through the portion of substrate 40 passing through vacuum envelope 10. In this manner the sealing of vacuum envelope 10 may be simplified dramatically.

The Driver System

The driver system 70 is the electronics mounted or fabricated on the rear of substrate 40 that (a) receive the image data from the outside world, (b) process the data and (c) deliver the image and gray scale data to the pixels by the vias 50 through substrate 40. Driver system 70 may be accomplished utilizing either separate silicon integrated circuit chips 72 mounted to the rear 44 of substrate 40 (see FIG. 1) or by fabricating the driver electronics directly onto the rear 40 of the Substrate using TFT technology. A very important task of the driver system 70 is to provide gray scale capability to the display.

The following discussion relates to the silicon chip embodiment of driver system 70. CMOS is the most widely used IC technology and most foundries that make custom chips use this process. CMOS is the technology commonly used to make memory chips. However, if an NMOS (Negative-channel Metal-Oxide Semiconductor) technology is used instead of CMOS, the costs of the driver chips will be greatly reduced because NMOS uses fewer layers. Also, using either CMOS or NMOS, there is no need to use sub-micron process technology, which will further bring down the cost for a wafer. In high production, in a dedicated chip product facility, the cost of the wafer producing driver chips for this invention should be much lower than the cost of the present CMOS wafers. If a larger size wafers are used, the cost comes down even further.

Also, the metalization system used to manufacture the driver chips 72 must be able to handle the sealing temperature used to seal the vacuum envelope 10 without adverse changes to its contact with silicon. This can be done using a refractory-gold system that was developed at Power Hybrids, Inc. in the 1970s.

If semiconductor chips 72 are used as the driver system 70, they are attached using a "flip-chip" gold bump contact system. This system requires two issues to be addressed: 1) the gold bumps themselves and 2) aligning the chip to the substrate.

First, gold bumps 82 are applied to the completed silicon wafers. Second, the silicon chips are accurately aligned blindly using alignment markers located on substrate 40 and the corners of chips 72. Alternately, an infrared alignment systems can be used to mount the chips. Tested good substrates 40 and tested good gold-bumped driver chips 72 are assembled together using gold-to-gold thermal compression bonding. The objective is to get the thousands of gold bumps 82 per chip 82 to make ohmic contact with the gold plated pads 84 on the rear 44 of substrate 40. Gold is an extremely malleable metal and will conform to the non-planarities between substrate 40 and chip 72.

If TFT techniques are used to create a driver system 70, the rear of substrate 40 is patterned with contact pads 84 for the source and drain of the channel of the thin film transistors, and a pad 84 is also patterned next to the channel area for the gate electrode to contact with. In fabrication, the rear 44 of substrate 40 is cleaned and a suitable semiconductor material, such as cadmium selenide, is deposited between the source and drain pads and patterned, creating a channel. A suitable insulator, such as silicon dioxide or titanium oxide, are then deposited and patterned over the channel area and any other areas needing insulation. Finally, a suitable gate and interconnect material, such as aluminum or gold, is deposited and patterned over the gate oxide and any other areas requiring interconnect. The completed driver is then sealed with a suitable oxide coating, such as silicon dioxide, to protect it in handling and operation.

The Electron Source and Vacuum Vessel

The finished substrate 40 with phosphor coated metal pads 60 on the front 42 and driver electronics 70 mounted/fabricated on the rear 44, is sealed in a vacuum vessel envelope 10 with a suitable electron source, such as thermionic wire filaments 30 (See FIG. 3). The rear 44 of driver electronics 70 may actually lay up against the inside of the rear pane 14 of vacuum envelope 10 to support it or it may be bonded directly to the rear pane 14 before or during sealing of the display for added support.

In an alternative embodiment substrate 40 replaces the rear pane 14 of vacuum envelope 10. In this embodiment rear 44 of substrate 40 is actually external to the display. This embodiment may be better suited to use with a substrate as described above that utilizes electrical connections other than a via 50 directly through substrate 40, in order to avoid vacuum stress on the conductive metal 54 connecting conductive anode pads 62 to driver circuitry 70.

Thermionic wire filaments 30 may be used as the electron source, which allows a uniform spacing between the electron source and substrate 40, creating a more uniform luminosity for the image across the entire area of the screen. If thermionic wire filaments 30 are utilized as the electron source, there may be discontinuities in the brightness of the phosphor areas directly under the thermionic filaments 30 and those phosphor areas located between thermionic filaments 30. This discontinuity can be removed by reshaping the electron cloud that is emitted by the thermionic wire filaments using shaping charges on a series of transparent conductive strips, such as Indium Tin Oxide (ITO), deposited on the inside of the vacuum vessel (not shown). The conductive strips are aligned parallel to the thermionic wire filaments 30. By application of the proper voltage potential to the strips, the areas of high electron density (those areas closest to the thermionic wire filament 30) are attracted/repelled towards the areas of low electron density (those areas farthest from the thermionic wire filaments 30), evening out the electron densities and therefore evening out any discontinuity in the brightness of the phosphor in different areas of the display.

Although thermionic wire filaments 30 are disposed between front pane 12 and phosphor coated metal pads 60, the image seen by the viewer is not impaired because the glow of thermionic wire filaments 30 is barely noticeable at normal viewing distances. Thermionic wire filaments 30 operate at relatively low voltages, because the pixels are continuously active and do not need the same intensity of activation as a scanned display. In essence, the intense, rapid excitation of the phosphors of a scanned display is replaced with a less intense but longer excitation, and hence thermionic wire filaments 30 need not glow as intensely as in previous VFDs. Compensation for this glow may be attained by adjusting the luminosity of pixels near the filament or by other appropriate techniques.

Substrate 40 can be an integral part of the vacuum envelope 10 (as seen in FIG. 3) or can be contained entirely inside the vacuum envelope 10, with only the data and power leads 32 passing out of the display through the glass-to-glass frit seals 18 of front pane 12 and rear pane 14 of the vacuum envelope 10.

If substrate 40 is an integral part of the vacuum vessel/envelope 10, then it separates the vacuum space 20 enclosed by vacuum envelope 10 into a front cavity 22 and a rear cavity 24. Front cavity 22 is defined by front pane 12, substrate 40 and a first side collar 26. Rear cavity 24 is defined by rear pane 14, substrate 40 and a second side collar 28. First side collar 26 and second side collar 28 may be integral to front pane 12 and rear pane 14, respectively, or may be separate pieces. An example of such side collars is illustrated in U.S. Pat. No. 6,172,457.

In either case, rear cavity 24 may be of minimal size if the rear 44 of driver electronics 70 lies against the inside of the rear pane 14 of vacuum envelope 10, as described above.

Substrate 40 may also contain a series of small equalization holes 46 that are plated with a conductor, such as aluminum, and all the plated holes 46 are connected to a lead that is connected to a negative voltage potential. These equalization holes 46 serve to allow evacuation of the air in the display through vacuum port 16 disposed within second side collar 28 during manufacture and the free flow of residual gas molecules that "out gas" during display operation. However, during operation, electrons emitted by the electron source 30 in the front cavity 22 of the display cannot travel through these holes 46 to the rear cavity 24 of the display because of the negative voltage potential on the conductive plating throughout hole 46. In effect, these holes 46 act as specialized gas valves that do not allow any ionized gas (or particle) to pass through. Electrons that may move to the rear cavity 24 of the display may interfere with the proper operation of the display electronics, and holes 46 act to shield the rear cavity from undesired inflow of electrons into rear cavity 24.

While the preferred embodiment of the invention has been illustrated and described, many changes can be made without departing from the spirit and scope of the invention. Accordingly, the scope of the invention is not limited by the disclosure of the preferred embodiment. Instead, the invention should be determined entirely by reference to the claims that follow.

I claim:

1. A display device comprising:

an envelope for enclosing a space containing a vacuum, said envelope further comprising a first pane of a transparent material and a second pane substantially parallel to said first pane;

a substrate panel having first and second parallel sides, said substrate panel disposed between said first pane and said second pane and within said enclosed space of said envelope such that said substrate panel and said first pane are spaced from one another, said first side of said substrate panel being closer than said second side of said substrate panel to said first pane of said envelope;

a plurality of conductive anode pads disposed on said first side of said substrate panel, said conductive anode pads being covered with light-emissive phosphor coatings;

driver circuitry for selectively activating individual ones of said conductive anode pads, said driver circuitry being disposed on said second side of said substrate panel;

a plurality of conductive vias connecting said conductive anode pads with said driver circuitry, a unique one of such conductive vias connecting each separate conductive anode pad to said driver circuitry; and an electron source disposed between said first side of said substrate panel and said first pane of said envelope and spaced from said substrate such that a vacuum space is maintained between said electron source and said conductive anode pads disposed on said first side of said substrate panel.

2. The display of claim 1 wherein said electron source comprises a plurality of thermionic filaments.

3. The display of claim 1 wherein each one of said conductive vias comprises a hole filled with a conductive material passing entirely through said substrate panel.

4. The display of claim 1 wherein said conductive vias pass partly through said substrate panel and connect to embedded traces that connect to said driver circuitry.

5. A display device comprising:

an envelope for enclosing a space containing a vacuum, said envelope further comprising a first pane of a transparent material and a second pane comprising a substrate panel substantially parallel to said first pane;

said a substrate panel having first and second parallel sides, said first side of said substrate panel defining the interior of said space and thus closer than said second side of said substrate panel to said first pane of said envelope;

a plurality of conductive anode pads disposed on said first side of said substrate panel, said conductive anode pads being covered with light-emissive phosphor coatings;

driver circuitry for selectively activating individual ones of said conductive anode pads, said driver circuitry being disposed on said second side of said substrate panel;

a plurality of conductive vias connecting said conductive anode pads with said driver circuitry, a unique one of such conductive vias connecting each separate conductive anode pad to said driver circuitry; and an electron source disposed between said first side of said substrate panel and said first pane of said envelope and spaced from said substrate such that a vacuum space is maintained between said electron source and said conductive anode pads disposed on said first side of said substrate panel.

6. The display of claim 5 wherein said electron source comprises a plurality of thermionic filaments.

7. A display device comprising:

an envelope for enclosing a space containing a vacuum, said envelope further comprising:

a first pane of a transparent material;

a second pane substantially parallel to said first pane;

a substrate panel having first and second parallel sides, said substrate panel disposed between said first pane and said second pane and spaced apart therefrom;

a first side collar for sealing the space between said first pane and said substrate panel, wherein said first pane, said first side of said substrate panel and said first side collar define a front cavity;

a second side collar for sealing the space between said second pane and said substrate panel, wherein said second pane, said second side of said substrate panel and said second side collar define a rear cavity;

a plurality of conductive anode pads disposed on said first side of said substrate panel, said conductive anode pads being covered with light-emissive phosphor coatings;

driver circuitry for selectively activating individual ones of said conductive anode pads, said driver circuitry being disposed on said second side of said substrate panel;

a plurality of conductive vias connecting said conductive anode pads with said driver circuitry, a unique one of such conductive vias connecting each separate conductive anode pad to said driver circuitry; and an electron source disposed within said front space and spaced from said substrate such that a vacuum space is maintained between said electron source and said conductive anode pads disposed on said first side of said substrate panel.

8. The display of claim 7 wherein said electron source comprises a plurality of thermionic filaments.

9. The display of claim 7 wherein each one of said conductive vias comprises a hole filled with a conductive material passing entirely through said substrate panel.

10. The display of claim 7 wherein said conductive vias pass partly through said substrate panel and connect to embedded traces that connect to said driver circuitry.

* * * * *